US009376928B2

(12) United States Patent
Lazzari et al.

(10) Patent No.: US 9,376,928 B2
(45) Date of Patent: Jun. 28, 2016

(54) POWER SYSTEM ENCLOSURE

(71) Applicant: Solar Turbines Inc., San Diego, CA (US)

(72) Inventors: Franco Lazzari, Gravesano (CH); Luigi Pedrini, Cimo (CH); Marco Ghislanzoni, Maccagno (IT); Nicola Müller, Roveredo (CH)

(73) Assignee: Solar Turbines Incorporated, San Diego, CA (US)

( * ) Notice: Subject to any disclaimer, the term of this patent is extended or adjusted under 35 U.S.C. 154(b) by 214 days.

(21) Appl. No.: 14/064,364

(22) Filed: Oct. 28, 2013

(65) Prior Publication Data

US 2015/0116934 A1 Apr. 30, 2015

(51) Int. Cl.
*F01D 15/10* (2006.01)

(52) U.S. Cl.
CPC ..... *F01D 15/10* (2013.01)

(58) Field of Classification Search
CPC ..... F01D 15/10
See application file for complete search history.

(56) References Cited

U.S. PATENT DOCUMENTS 3,791,682 A * 2/1974 Mitchell ..... F02C 7/20 290/1 R
5,003,961 A * 4/1991 Besik ..... F24F 3/1411 126/110 R
5,702,299 A * 12/1997 Sundholm ..... A62C 35/60 169/37
5,775,434 A * 7/1998 Sundholm ..... A62C 99/0072 169/46
6,786,051 B2 * 9/2004 Kristich ..... F01D 25/28 60/796
8,180,495 B1 * 5/2012 Roy ..... H05K 7/20745 165/67
8,238,104 B2 * 8/2012 Salpeter ..... H05K 7/1488 165/104.33
2002/0164944 A1 * 11/2002 Haglid ..... B25B 27/0035 454/228
2003/0070787 A1 * 4/2003 Moffitt ..... F24F 12/001 165/4
2006/0080971 A1 * 4/2006 Smith ..... F01D 21/003 60/797
2007/0155303 A1 * 7/2007 Choi ..... F24F 3/1411 454/258
2010/0015905 A1 * 1/2010 Hu ..... F24F 7/007 454/258
2010/0110626 A1 * 5/2010 Schmitt ..... H05K 7/20745 361/679.47
2010/0112925 A1 * 5/2010 Schmitt ..... H05K 7/20745 454/184
2010/0120345 A1 * 5/2010 Ryan ..... B60H 1/00371 454/75
2010/0317278 A1 * 12/2010 Novick ..... H05K 7/20836 454/184
2010/0323607 A1 * 12/2010 Newcomer ..... F24F 3/044 454/342

(Continued)

*Primary Examiner* — David M Sinclair
*Assistant Examiner* — Robert Brown
(74) *Attorney, Agent, or Firm* — James R. Smith

(57) ABSTRACT

A power system enclosure is provided. The power system enclosure includes a housing accommodating a power source. The power system enclosure further includes an enclosure inlet connected to the housing to allow entry of an intake fluid into the housing. An enclosure exhaust is connected to the housing to route fluid from the housing. Further, a relief damper is disposed in the enclosure exhaust. At least a portion of the relief damper is configured to open when a pressure within the housing exceeds a predetermined threshold value.

16 Claims, 11 Drawing Sheets

(56) References Cited

U.S. PATENT DOCUMENTS

2011/0105015 A1* 5/2011 Carlson ..... H05K 7/20745 454/253
2011/0235272 A1* 9/2011 Bash ..... H05K 7/20609 361/692
2011/0272034 A1* 11/2011 Fex, Jr. ..... E04H 9/14 137/1
2012/0028559 A1* 2/2012 Kingston ..... H05K 5/0213 454/184
2012/0028563 A1* 2/2012 Sacks ..... F24F 11/0001 454/258
2012/0077429 A1* 3/2012 Wernimont ..... F24F 3/161 454/187
2013/0005237 A1* 1/2013 Baten ..... F02C 3/32 454/252
2013/0017774 A1* 1/2013 Zorzit ..... F24F 1/0007 454/239
2013/0078901 A1* 3/2013 Curtin ..... H05K 7/20745 454/184
2013/0163201 A1* 6/2013 Wang ..... H05K 5/0213 361/692
2013/0237140 A1* 9/2013 Contreras ..... F24F 11/0076 454/239
2013/0242542 A1* 9/2013 Uchimi ..... F21V 29/027 362/97.1
2013/0279112 A1* 10/2013 Kim ..... H05K 7/20154 361/692
2014/0041401 A1* 2/2014 Douglas ..... F25B 43/00 62/89
2014/0170958 A1* 6/2014 Cursetjee ..... F24F 13/28 454/292
2014/0185239 A1* 7/2014 Yu ..... H05K 7/20145 361/692
2014/0213169 A1* 7/2014 Rasmussen ..... H05K 7/20745 454/237
2014/0242902 A1* 8/2014 Ali ..... F24F 13/14 454/359
2014/0245748 A1* 9/2014 Anghel ..... F01D 15/10 60/783
2014/0373826 A1* 12/2014 Cote ..... F24D 19/1084 126/110 A
2015/0204301 A1* 7/2015 Williams ..... F03B 13/08 290/52

* cited by examiner

POWER SYSTEM ENCLOSURE

TECHNICAL FIELD

The present disclosure relates to a power system enclosure, and more particularly to a ventilation system for a power system enclosure.

BACKGROUND

A conventional power system includes an enclosure for accommodating a power source, such as an engine. The power system also includes a ventilation system in order to ventilate exhaust gases produced during an operation of the power source. Such a ventilation system typically includes components such as ducts, vents, fans, sensors, dampers, and the like. Further, the power system is provided with a fire extinguishing system to cater to a fire emergency inside the enclosure. The ventilation system may selectively prevent gases, produced during fire extinguishing, from escaping the enclosure.

U.S. Patent Publication No. 2006080971 discloses an enclosure comprising elements for air management, sound attenuation and fire suppression in an electrical power generation system. Air management is provided by ducts, fans, seals and a barrier wall. In addition, by establishing airflow away from spark-producing equipment, any fuel that might leak will not accumulate near the spark-producing equipment, and thus fire and explosion risks are reduced. Targeted sound suppression in the ducts, walls, floor and ceiling of the enclosure provides acceptable noise levels. Fire detectors, a fire suppression system and dampers allow for quickly controlling fires inside the enclosure. A roof panel sealing system provides access into the enclosure during assembly and maintenance while providing a watertight and noise tight seal during transit and operations.

SUMMARY

In one aspect of the present disclosure, a power system enclosure is described. The power system enclosure includes a housing accommodating a power source. The power system enclosure further includes an enclosure inlet connected to the housing to allow entry of an intake fluid into the housing, an enclosure exhaust connected to the housing to route fluid from the housing, and a relief damper disposed in the enclosure exhaust. At least a portion of the relief damper is configured to open when a pressure within the housing exceeds a predetermined threshold value.

Other features and aspects of this disclosure will be apparent from the following description and the accompanying drawings.

DETAILED DESCRIPTION

Figure 1:
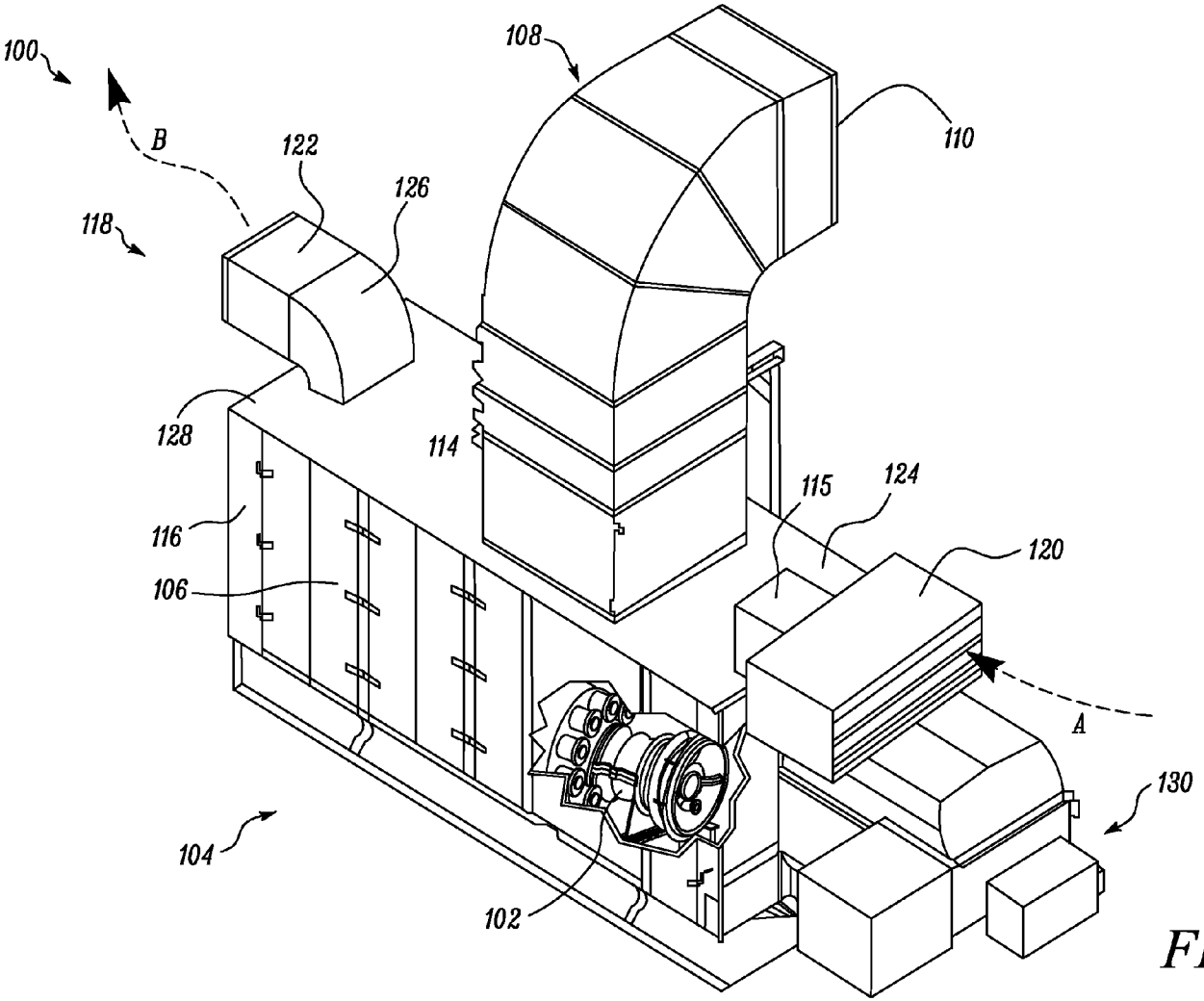
FIG. 1 is a break away perspective view of a power system, in accordance with an embodiment of the present disclosure.

The present disclosure relates to a power system 100. FIG. 1 shows a break away perspective view of the power system 100 in which the disclosed embodiments may be implemented. In an embodiment, the power system 100 may be stationary. In an alternative embodiment, the power system 100 may be mobile, for example, a trailer-mounted mobile electrical power generation system. The power system 100 includes a power source 102, and a power system enclosure 104. The power source 102 may be an engine of any type. In one embodiment, the power source 102 may be a gas turbine engine, which may be used to drive a generator for power generation, or other mechanical assemblies such as a compressor. In other embodiments, the power source 102 may be a reciprocating engine, such as a diesel engine, or a gas engine.

The power system enclosure 104 includes a housing 106 accommodating the power source 102. The housing 106 is sized and shaped to house the power source 102. The housing 106 may also accommodate the equipment driven by the power source 102. As shown in FIG. 1, the housing 106 may be cuboidal. In other embodiments, the housing 106 may have any alternative shapes, for example, cylindrical, spherical, or the like. A person of ordinary skill in the art will acknowledge that the shape of the housing 106 disclosed herein is exemplary in nature and does not limit the scope of this disclosure.

In an embodiment, the power system enclosure 104 includes a power source air system 108 connected to the housing 106. The power source air system 108 includes an inlet 110 and an exhaust (not shown). The inlet 110 may provide atmospheric air to the power source 102 for combustion of fuel. The exhaust may discharge exhaust gases coming from the power source 102 after combustion of the fuel. In an embodiment, the exhaust may be provided in the power source air system 108 such that the exhaust gases from the power source 102 is routed through the power source air system 108. Thus, the exhaust gases may remain isolated from a fluid inside the housing 106. In an alternative embodiment, exhaust gases may be mixed with the fluid inside the housing 106.

In an embodiment, as illustrated in FIG. 1, the inlet 110 is shown to be connected at a top 114 of the housing 106. However, in alternate embodiments, the inlet 110 may be positioned and connected to any other suitable portion of the housing 106, such as, on any one side 116 of the housing 106.

As illustrated in FIG. 1, the power system enclosure 104 includes a ventilation system 118. The ventilation system 118 includes an enclosure inlet 120, and an enclosure exhaust 122. The enclosure inlet 120 and the enclosure exhaust 122 may be disposed outside the housing 106. The enclosure inlet 120 is connected to the housing 106 to allow entry of an intake fluid into the housing 106 (as shown by dashed lines A with arrows). In an embodiment, the intake fluid may be air. As shown in FIG. 1, the enclosure inlet 120 may be connected proximate a first end 124 of the housing 106.

Figure 2:
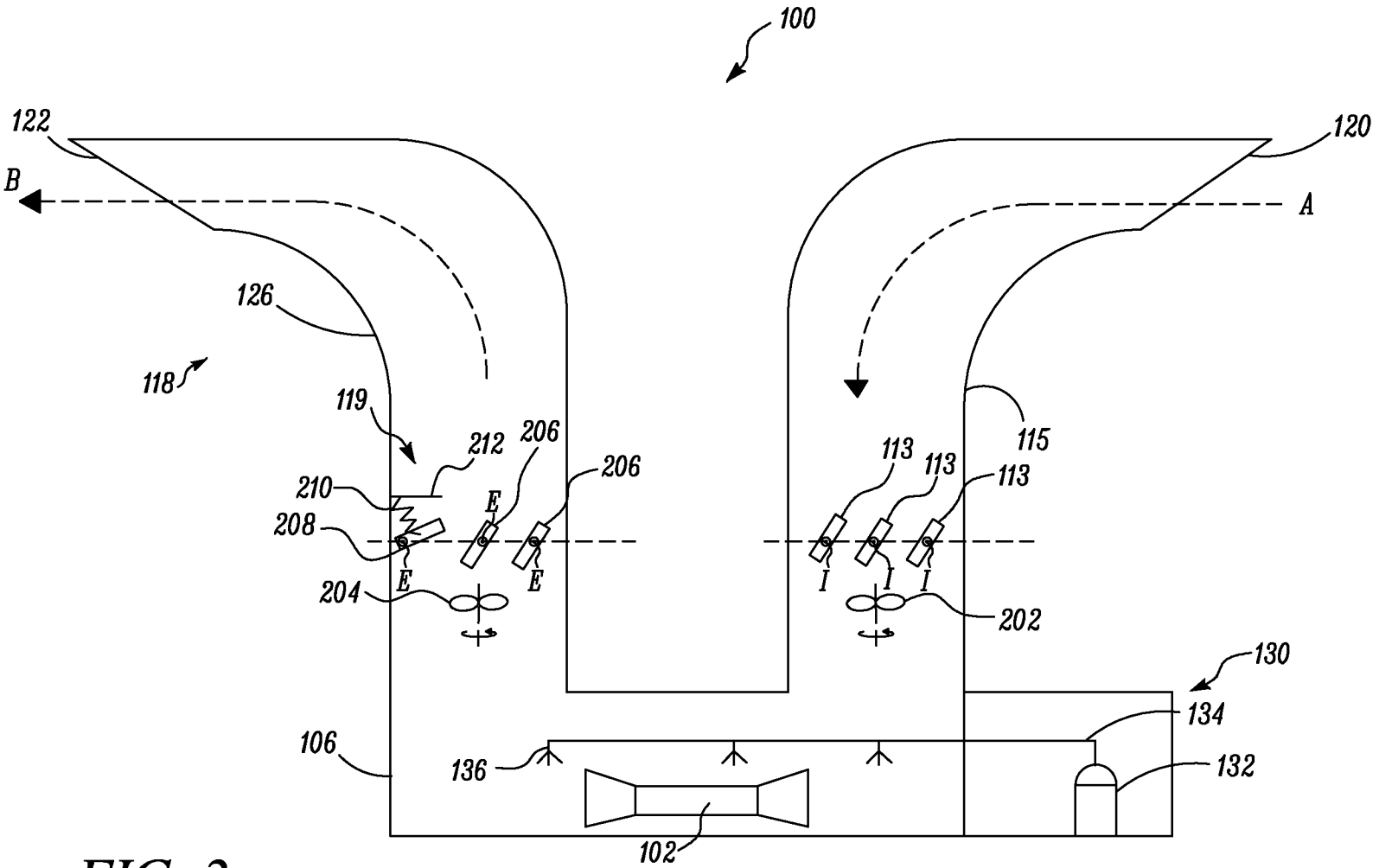
FIG. 2 is a front schematic view of the power system of FIG. 1 during a normal operational mode, according to one embodiment.

In an embodiment, the enclosure inlet 120 may include an inlet fan 202 (shown in FIG. 2), and one or more inlet dampers 113 (shown in FIG. 2). The inlet fan 202 may provide a suction force to the intake fluid entering the enclosure inlet 120. Alternatively, the intake fluid may enter by natural convection. The inlet dampers 113 are disposed in an inlet duct 115. The intake fluid entering the enclosure inlet 120, either by forced suction or by natural convection, enter through the inlet dampers 113 and flows around the power source 102 within the housing 106. The intake fluid may absorb heat radiated from the power source 102, and cool the housing 106 while also diffusing any gaseous component present inside the housing 106. In cases of the inlet fan 202 being used, the inlet fan 202 may enhance a flow rate of the intake fluid through the enclosure inlet 120 and the housing 106. Thus, an increased flow rate of the intake fluid may help in absorbing more heat from the power source 102 and cooling the housing 106 while diffusing any gaseous component present in the housing 106. In an alternative embodiment (not shown), the enclosure inlet 120 may provide air required by the power source 102 for combustion of fuel, thereby obviating the need for the power source air system 108.

The enclosure exhaust 122 includes an exhaust duct 126, and an outlet damper assembly 119 (shown in FIG. 2). The exhaust duct 126 is connected to the housing 106 to route exhaust gases from the housing 106 through the outlet damper assembly 119. As shown in FIG. 1, the exhaust duct 126 may be connected proximate a second end 128 of the housing 106.

In an embodiment, the enclosure exhaust 122 may further include an outlet fan 204 (shown in FIG. 2) that is configured to blow out exhaust gases from within the housing 106. As in the case of the inlet fan 202 provided at the enclosure inlet 120, the outlet fan 204 at the enclosure exhaust 122 may also facilitate in a forced convection of the exhaust gases. Thus, the outlet fan 204 at the enclosure exhaust 122 may enable the enclosure exhaust 122 to route the exhaust gases (as shown by dashed lines B with arrows) into atmosphere via the exhaust duct 126. In various alternative embodiments (not shown), one of the inlet fan 202 and the outlet fan 204 may be provided.

As shown in FIG. 1, the enclosure inlet 120 and the enclosure exhaust 122 may be positioned at the top 114 of the housing 106. In another embodiment (not shown), the enclosure inlet 120 and the enclosure exhaust 122 may be positioned at the side 116 of the housing 106. Typically, the positioning of the enclosure inlet 120 and the enclosure exhaust 122 may be based on a flow pattern of the gases within the housing 106 while also taking into account the density of gases.

As shown in FIG. 1, the power system 100 further includes a fire extinguishing system 130. The fire extinguishing system 130 is operable during a fire emergency within the power system 100.

FIG. 2 illustrates a front schematic view of the power system enclosure 104 of the power system 100 during a normal operational mode. In an embodiment, the normal operational mode may correspond to a normal working of the power system 100.

As shown in FIG. 2, the ventilation system 118 includes the enclosure inlet 120. The enclosure inlet 120 is disposed outside the housing 106. The enclosure inlet 120 is connected to the housing 106 to allow entry of the intake fluid into the housing 106 (as shown by dashed lines A with arrows). The enclosure inlet 120 further includes the inlet fan 202. The inlet fan 202 is selectively configured to generate a flow of the intake fluid through the enclosure inlet 120. In an embodiment, the intake fluid is air. The enclosure inlet 120 further includes the inlet dampers 113. The inlet dampers 113 are pivotally disposed about an axis I in the inlet duct 115. Further, the inlet dampers 113 are configured to be opened during the normal operational mode. The inlet dampers 113 may be electrically, mechanically, hydraulically, and/or pneumatically operated.

FIG. 2 further illustrates the fire extinguishing system 130. The fire extinguishing system 130 includes a fire extinguishing material enclosure 132. The fire extinguishing material enclosure 132 may include dry chemical, foam, water, wet chemical and water additives, clean agents, carbon dioxide, aerosol, or the like, as a fire extinguishing agent. The fire extinguishing material enclosure 132 is further connected to a conduit 134. The conduit 134 is configured to transport the fire extinguishing agent from the fire extinguishing material enclosure 132 to an interior of the power system enclosure 104. The conduit 134 is further connected to one or more nozzles 136 disposed inside the power system enclosure 104. The nozzles 136 are configured to spray the fire extinguishing agent inside the power system enclosure 104 in case of a fire hazard. The ventilation system 118 of FIG. 2 further includes the enclosure exhaust 122. The enclosure exhaust 122 is disposed outside the housing 106. The enclosure exhaust 122 is connected to the housing 106 to route exhaust from the housing 106 (as shown by dashed lines B with arrows). The enclosure exhaust further includes the outlet fan 204. The outlet fan 204 is selectively configured to generate a flow of the exhaust gases through the enclosure exhaust 122. The enclosure exhaust 122 further includes the outlet damper assembly 119. The outlet damper assembly 119 includes one or more exhaust dampers 206 and a relief damper 208. The exhaust dampers 206 and the relief damper 208 are pivotally disposed about an axis E in the exhaust duct 126. As shown in FIG. 2, the exhaust dampers 206 are configured to be opened during the normal operational mode. Further, the relief damper 208 may be configured to remain at least partially open during the normal operational mode. In alternative embodiments, the relief damper 208 may be open during the normal operational mode, as will be described later with reference to FIG. 5. The exhaust damper 206 may be electrically, electronically, mechanically, hydraulically, and/or pneumatically operated. In an embodiment, the relief damper 208 is configured to operate against a pressure. Further the relief damper 208 is provided with a spring element 210 and a spring biasing element 212. In an alternative embodiment (not shown), a weight of the relief damper 208 may be used for actuating the relief damper 208, and the spring element 210 and the spring biasing element 212 may be absent. The spring biasing element 212 may support the spring element 210 such that the spring element 210 may normally bias the relief damper 208 towards a closed position. However, a pressure within the housing 106 may act against the spring biasing and keep the relief damper 208 at least partially open, as shown in FIG. 2. The pressure within the housing 106 may be generated by the inlet and/or outlet fans 202, 204. In an embodiment, the spring element 210 may be mechanical spring, such as, a coil spring, a torsion spring, or the like. The open positions of the inlet dampers 113, the exhaust dampers 206, and the relief damper 208, as shown in FIG. 2 are purely exemplary in nature, and the inlet dampers 113 and the exhaust dampers 206 may be pivotal to multiple angular orientations corresponding to multiple open positions.

Figure 3:
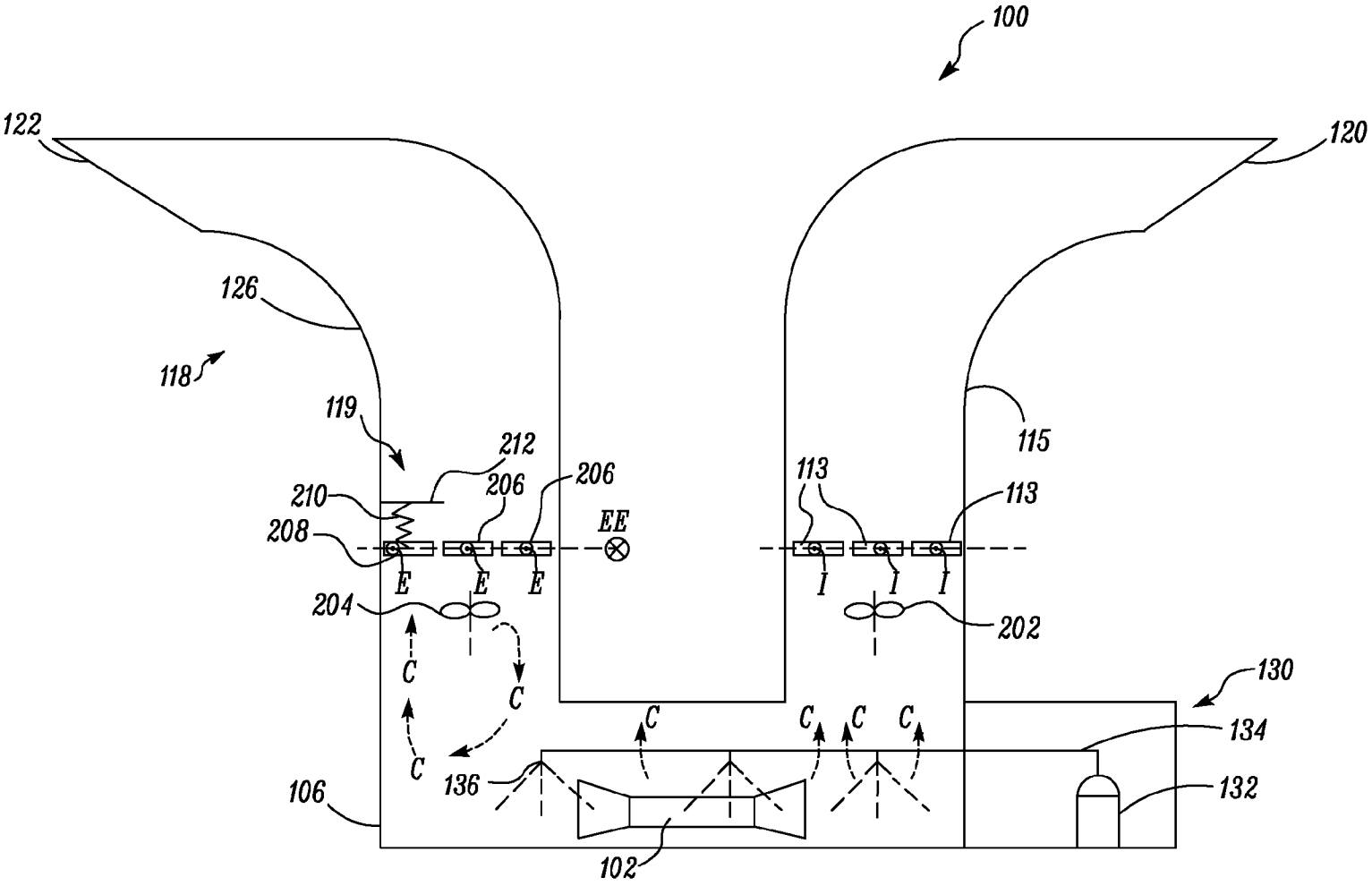
FIG. 3 illustrates a front schematic view of the power system of FIG. 2 during an event mode.

FIG. 3 illustrates a schematic front view of the power system enclosure 104 of the power system 100 during an event mode. The event mode may correspond to when a fire hazard has occurred in the power system 100. The fire hazard may be due an electrical failure like short circuiting inside the power system enclosure 104, fire due to oil or fuel leakage from the power source 102, rise in temperature of the housing 106 due to some electrical or mechanical failure etc.

During the event mode, the power source 102, the inlet fan 202, and the outlet fan 204 may be shut down. Further, the inlet dampers 113 and the exhaust dampers 206 are configured to be closed during the event mode. The pressure within the housing 106 may decrease when the inlet fan 202 and the outlet fan 204 are shut down. Thus, the relief damper 208 may close due to the spring biasing. The shutting down of the power source 102, the inlet fan 202, and the outlet fan 204, and the closing of the inlet dampers 113 and the exhaust dampers 206 may be controlled by an emergency system (not shown). The emergency system may include one or more smoke detectors, temperature detectors, flame detectors, or the like, which may be configured to initiate the shutting down of the power source 102, the inlet fan 202, and the outlet fan 204, and the closing of the inlet dampers 113 and the exhaust dampers 206.

FIG. 3 further illustrates suppression of the fire hazard by the fire extinguishing system 130 during the event mode. In operation, the fire extinguishing system 130 transports the fire extinguishing agent from the fire extinguishing material enclosure 132 through the conduit 134. The fire extinguishing agent reaches the nozzles 136 via the conduit 134 and is sprayed within the power system 100. FIG. 3 further illustrates accumulation of exhaust gases (shown by dashed lines C with arrows) inside the housing 106 after the fire has been extinguished in the power system 100. The exhaust gases, during the event mode, may include the fire extinguishing agent, and any residual gases from the fire hazard and/or the power source 102. In an embodiment, the exhaust gases may include carbon dioxide, which is used as the fire extinguishing agent.

Figure 4A:
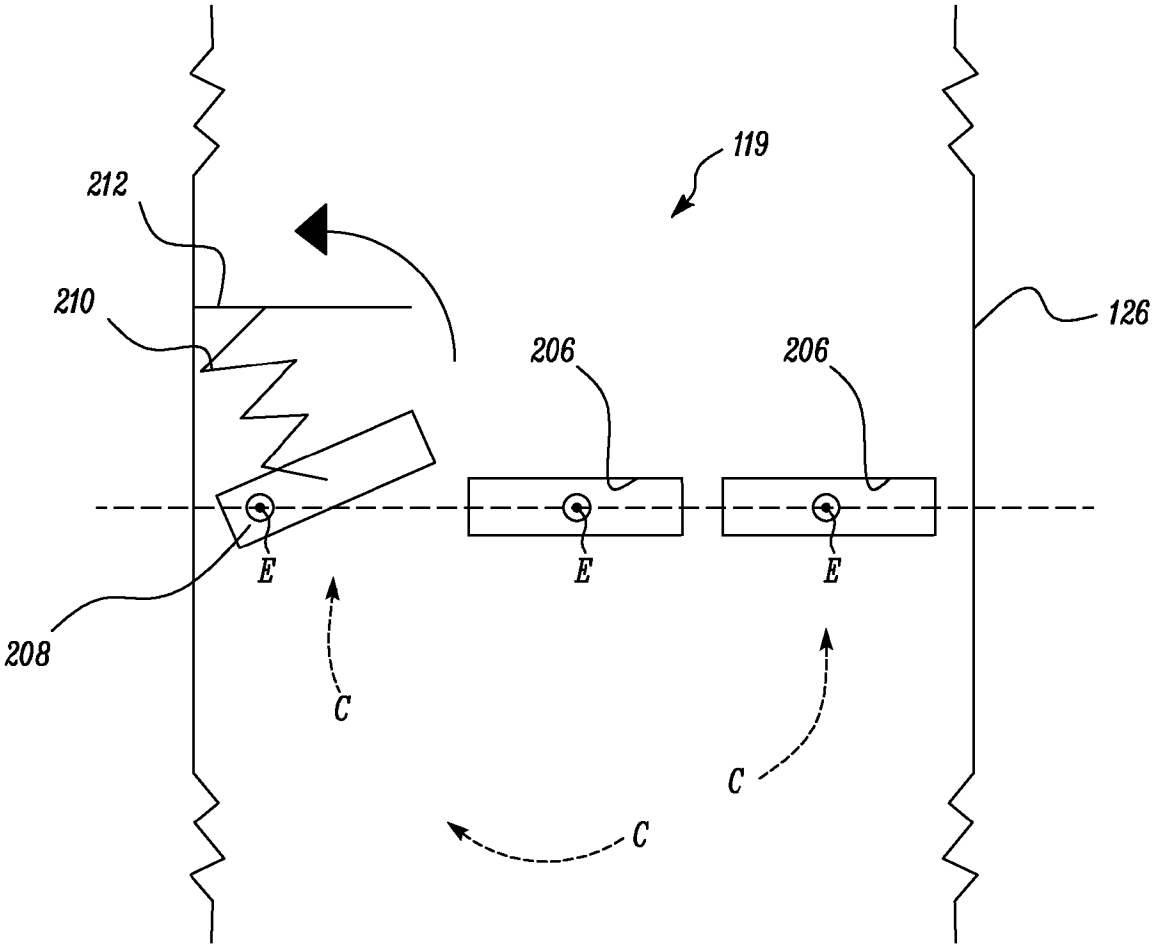
FIGS. 4A, 4B, and 4C illustrate front schematic views of an outlet damper assembly of the power system of FIG. 2 during an event mode.

FIG. 4A illustrates operation of the ventilation system 118 for discharging the exhaust gases from the power system 100, during the event mode. As mentioned earlier, during the event mode, the power source 102, the inlet fan 202, the outlet fan 204, the inlet dampers 113, and the exhaust dampers 206 are closed, and the fire extinguishing system 130 operates to extinguish the fire. As the fire gets extinguished in the housing 106 and the exhaust gases are accumulating, an exhaust gas pressure within the housing 106 starts building. The exhaust gases rise and further reach the outlet damper assembly 119. In operation, the relief damper 208 is configured to open when the exhaust gas pressure within the housing 106 exceeds a predetermined threshold value. The predetermined threshold value may be a safe pressure limit beyond which various components of the power system enclosure 104 may get damaged. In an embodiment, the predetermined threshold value is substantially equivalent to a turning moment required to rotate the relief damper 208 about the axis E, against the biasing of the spring element 210, to an open position, as shown in FIG. 4B.

Figure 4B:
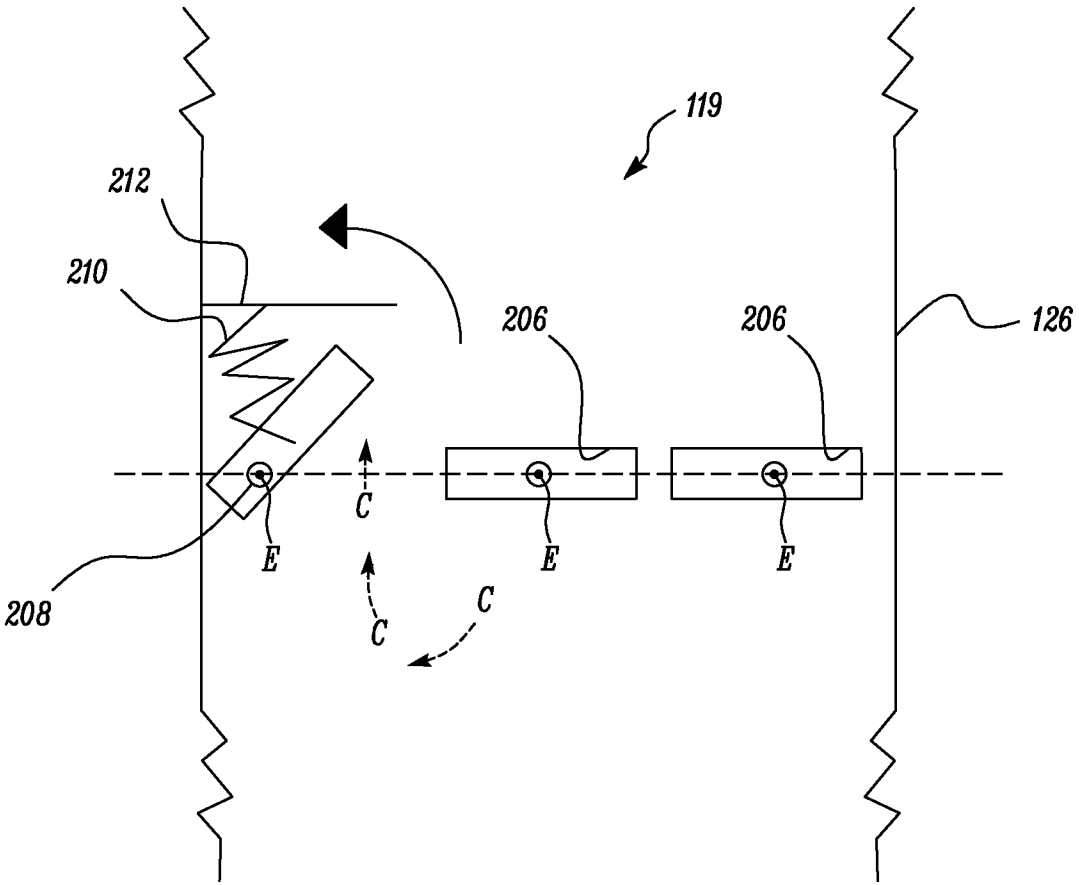

FIG. 4B illustrates a schematic front view of the relief damper 208 in the open position. As the exhaust gas pressure exceeds the predetermined threshold value, the relief damper 208 rotates to the open position, thereby enabling discharge of the exhaust gases (shown by the dashed lines C with arrows). Further, as the relief damper 208 is rotated to the open position, the spring element 210 may also get compressed against the spring biasing element 212. The spring element 210 thus develops an elastic compressive force.

Figure 4C:
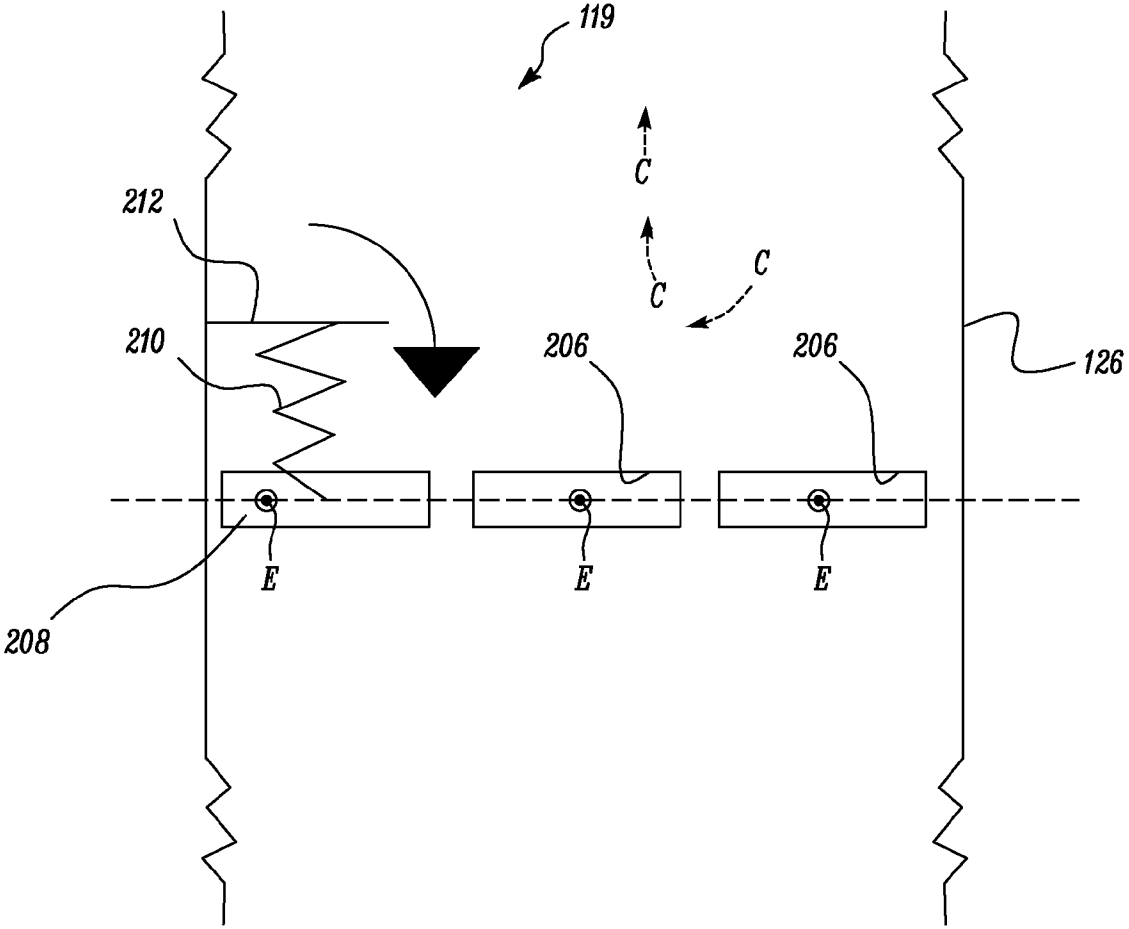

FIG. 4C illustrates a front schematic h view of the relief damper 208 during a closed position. As described earlier, with the opening of the relief damper 208 to the open position to discharge the exhaust gases, the spring element 210 develops the elastic compressive force. As the exhaust gases gets discharged from the housing 106, the exhaust gas pressure within the housing 106 drops. Further, as the exhaust gas pressure inside the housing 106 drops below the predetermined threshold value, the elastic compressive force of the spring element 210 actuates the relief damper 208 to the closed position. In other embodiments (not shown), the elastic compressive force of the spring element 210 may be replaced by the weight of the relief damper 208.

Figure 5:
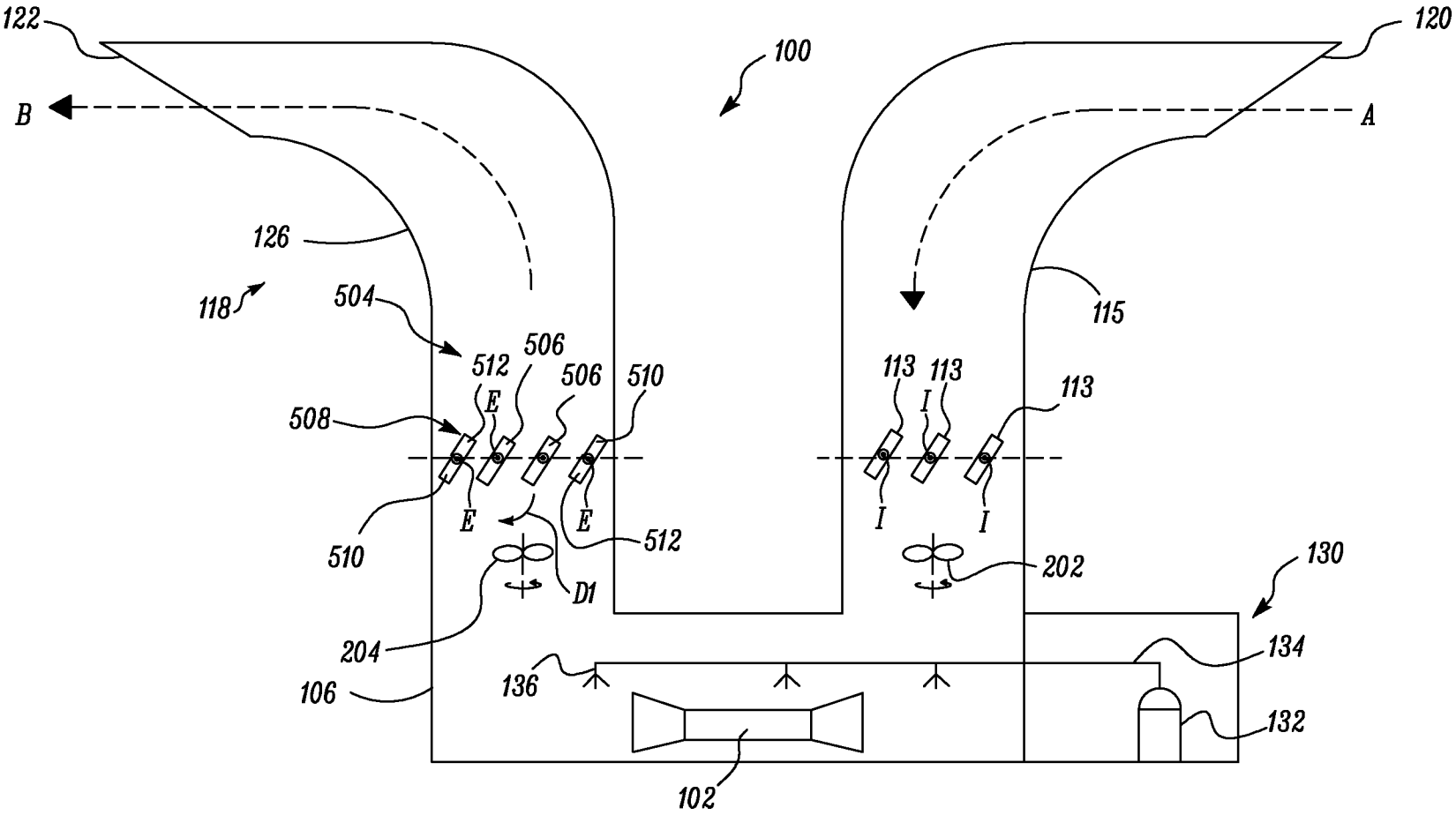
FIG. 5 is a front schematic view of the power system of FIG. 1 during a normal operational mode, according to another embodiment.

FIG. 5 illustrates a front schematic view of the power system enclosure 104 of the power system 100 during a normal operational mode, according to another embodiment of the present disclosure. As shown in FIG. 5, the ventilation system 118 includes the enclosure inlet 120. The enclosure inlet 120 is disposed outside the housing 106. The ventilation system 118 of FIG. 5 further includes the enclosure exhaust 122. The enclosure exhaust 122 is disposed outside the housing 106. The enclosure exhaust 122 includes the outlet damper assembly 504. Further, the outlet damper assembly 504 includes a plurality of exhaust dampers 506 and a plurality of relief dampers 508. The exhaust dampers 506 are pivotally disposed about the axis E in the exhaust duct 126.

Each of the relief dampers 508 includes a first portion 510 and a second portion 512. The relief dampers 508 are in an open position during the normal operational mode. The first portion 510 is pivotally connected to the second portion 512 about the axis E. The second portion 512 may also be pivotal about the axis E. The second portion 512 includes a plurality of support members 514 (shown in FIG. 7A) on which the first portion 510 rests. The support members 514 ensure that the first portion 510 rotates with the second portion 512 along a first direction D1, to a closed position (shown in FIG. 6). As shown in FIG. 5, the first direction D1 is a clockwise direction about the axis E. However, in alternative embodiments (not shown), the first direction D1 may be an anticlockwise direction. The exhaust damper 506 and the relief dampers 508 are configured to be opened during the normal operational mode. The exhaust damper 506 and the second portions 512 of the relief dampers 508 may be electrically, electronically, mechanically, hydraulically, and/or pneumatically operated. In other embodiments (not shown), the first portion 510 may be provided with a stabilization member, such as a spring, or the like, to reduce vibrations of the first portion 510.

Figure 6:
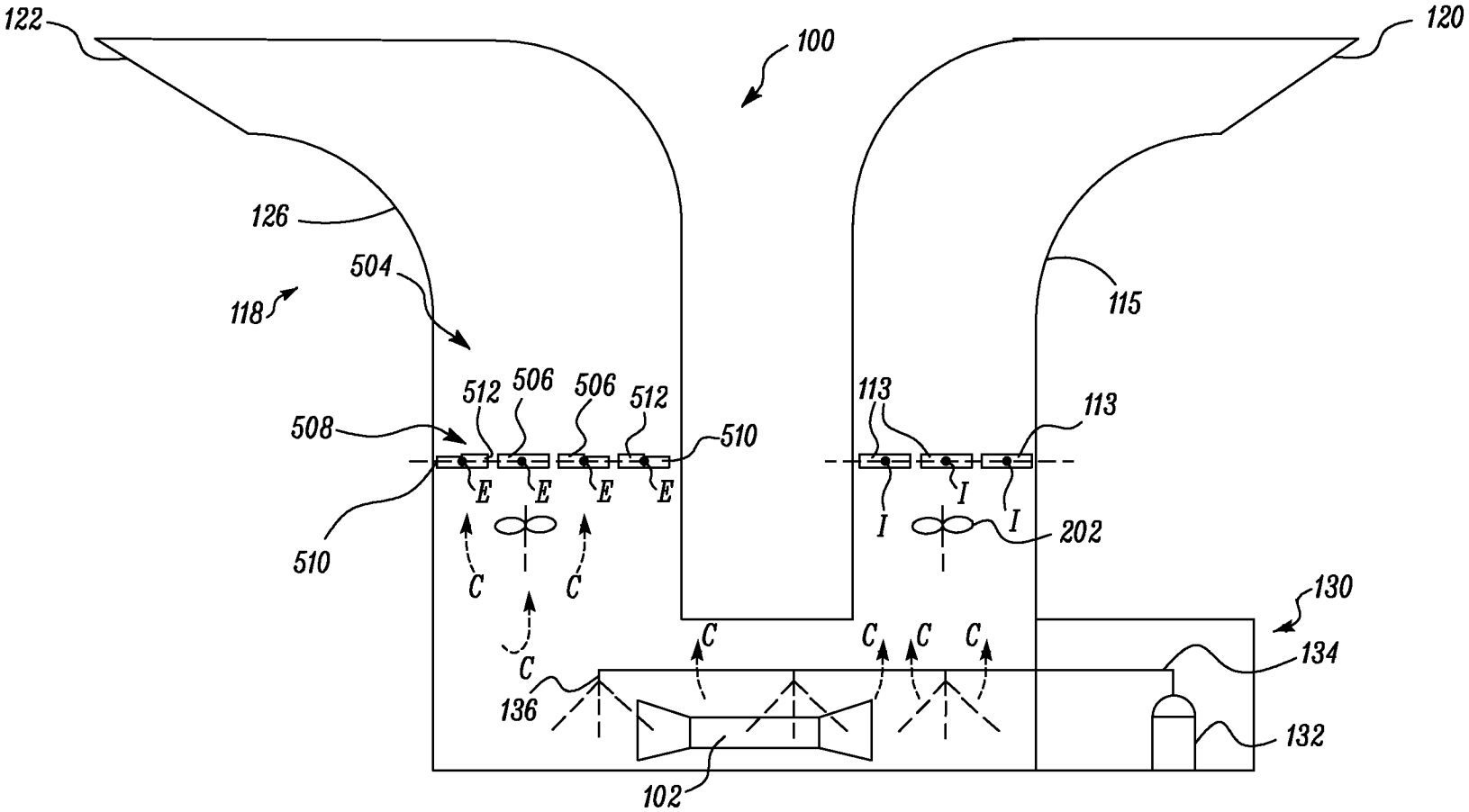
FIG. 6 illustrates a front schematic view of the power system of FIG. 5 during an event mode.

FIG. 6 illustrates a schematic front view of the power system enclosure 104 of the power system 100 pertaining to an event mode. The event mode may correspond to when a fire hazard has occurred in the power system 100.

FIG. 6 illustrates shutting down of the power source 102, the inlet fan 202, the outlet fan 204, the inlet dampers 113, and the outlet damper assembly 504 are configured to be closed during the event mode in a similar manner as explained with reference to FIG. 4. The first and second portions 510, 512 of each of the relief dampers 508 rotate together to the closed position. FIG. 6 further illustrates suppression of the fire hazard by the fire extinguishing system 130 during the event mode in a similar way as explained with reference to FIG. 4.

Figure 7A:
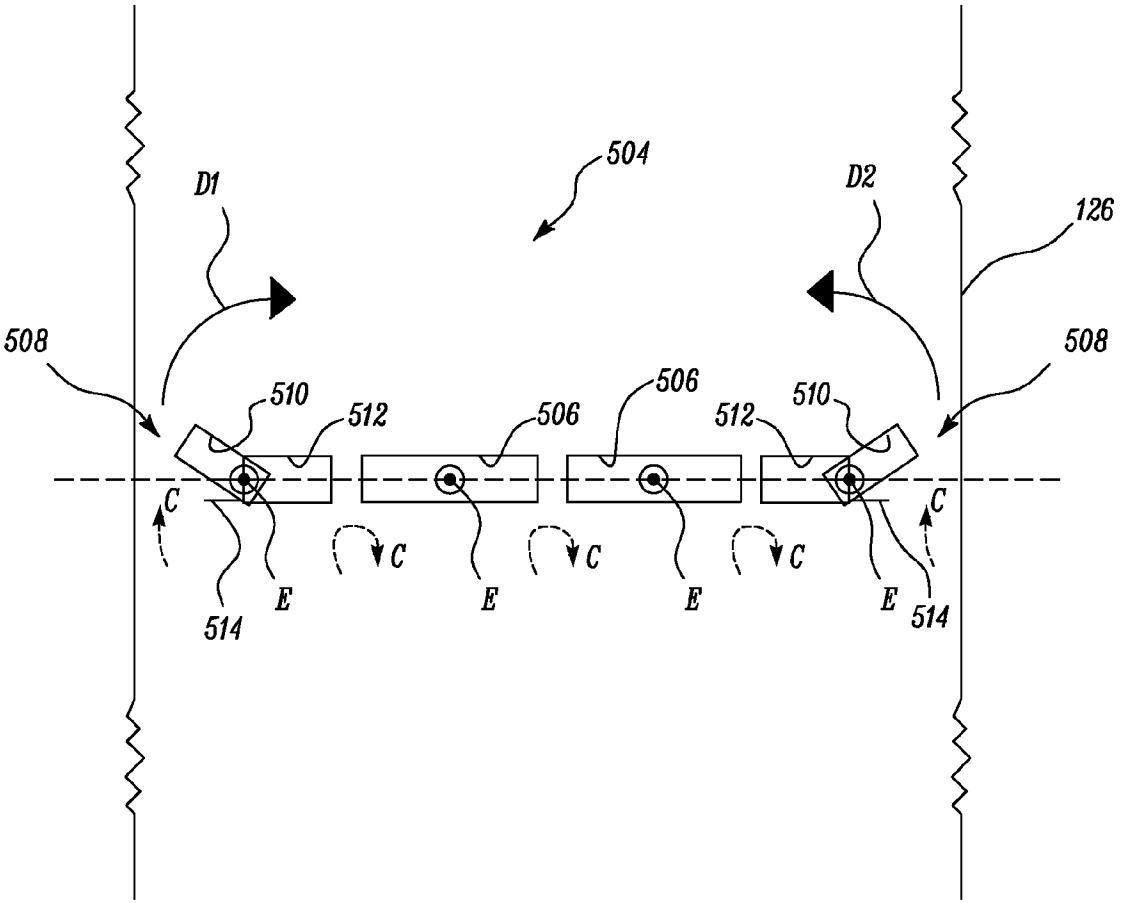
FIGS. 7A, 7B, and 7C illustrate front schematic views of the outlet damper assembly of the power system of FIG. 5 during an event mode.

FIG. 7A illustrates operation of the ventilation system 118 for discharging the exhaust gases from the power system 100 during the event mode. As mentioned earlier, during the event mode the power source 102, the inlet fan 202, the outlet fan 204, the inlet dampers 113, and the outlet damper assembly 504 are closed, and the fire extinguishing system 130 operates to extinguish the fire. As the fire gets extinguished in the housing 106 and the exhaust gases (shown by the dashed lines C with arrows) accumulate, the exhaust gas pressure within the housing 106 starts building. The exhaust gases rise and further reach the outlet damper assembly 504. In operation, the first portion 510 of the relief damper 508 is configured to open when the exhaust gas pressure within the housing 106 exceeds the predetermined threshold value. In an embodiment, the predetermined threshold value is substantially equivalent to a turning moment required to rotate the first portion 510 about the axis E. As shown in FIG. 7A, the first portion 510, located at one end, opens along a second direction D2, which is opposite to the first direction D1. Further, the first portion 510, which is located at an opposite end, opens along the first direction D1. The support members 514 may permit rotation of the first portions 510 along the first and second directions D1, D2.

Figure 7B:
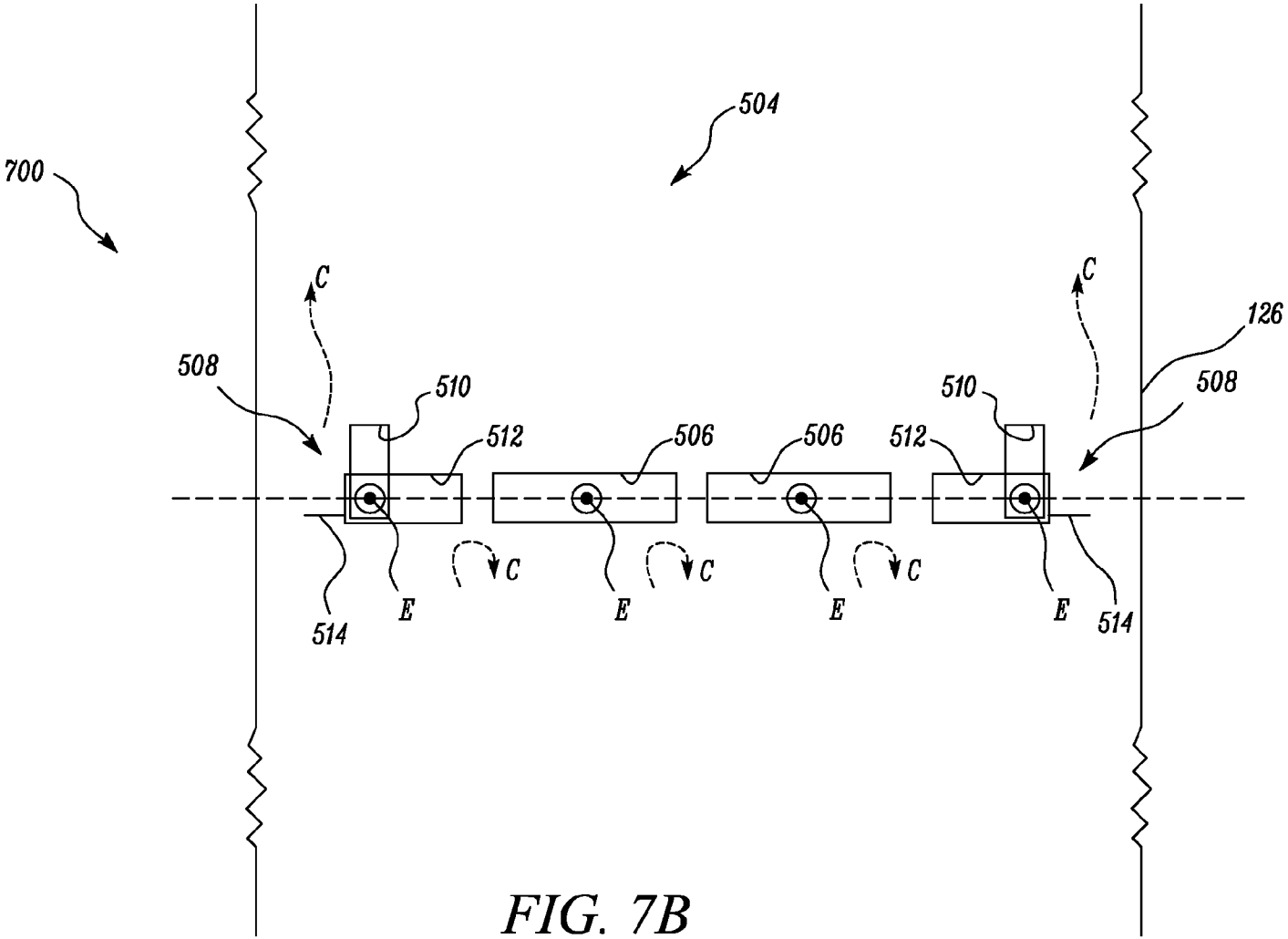

FIG. 7B illustrates a front schematic view of the first portion 510 in an open position. As the exhaust gas pressure exceeds the predetermined threshold value, the first portion 510 rotates to the open position, independent of the second portion 512, thus enabling discharge of the exhaust gases. Further, as the first portion 510 is rotated to the open position, the exhaust gas pressure supports a weight of the first portion 510.

Figure 7C:
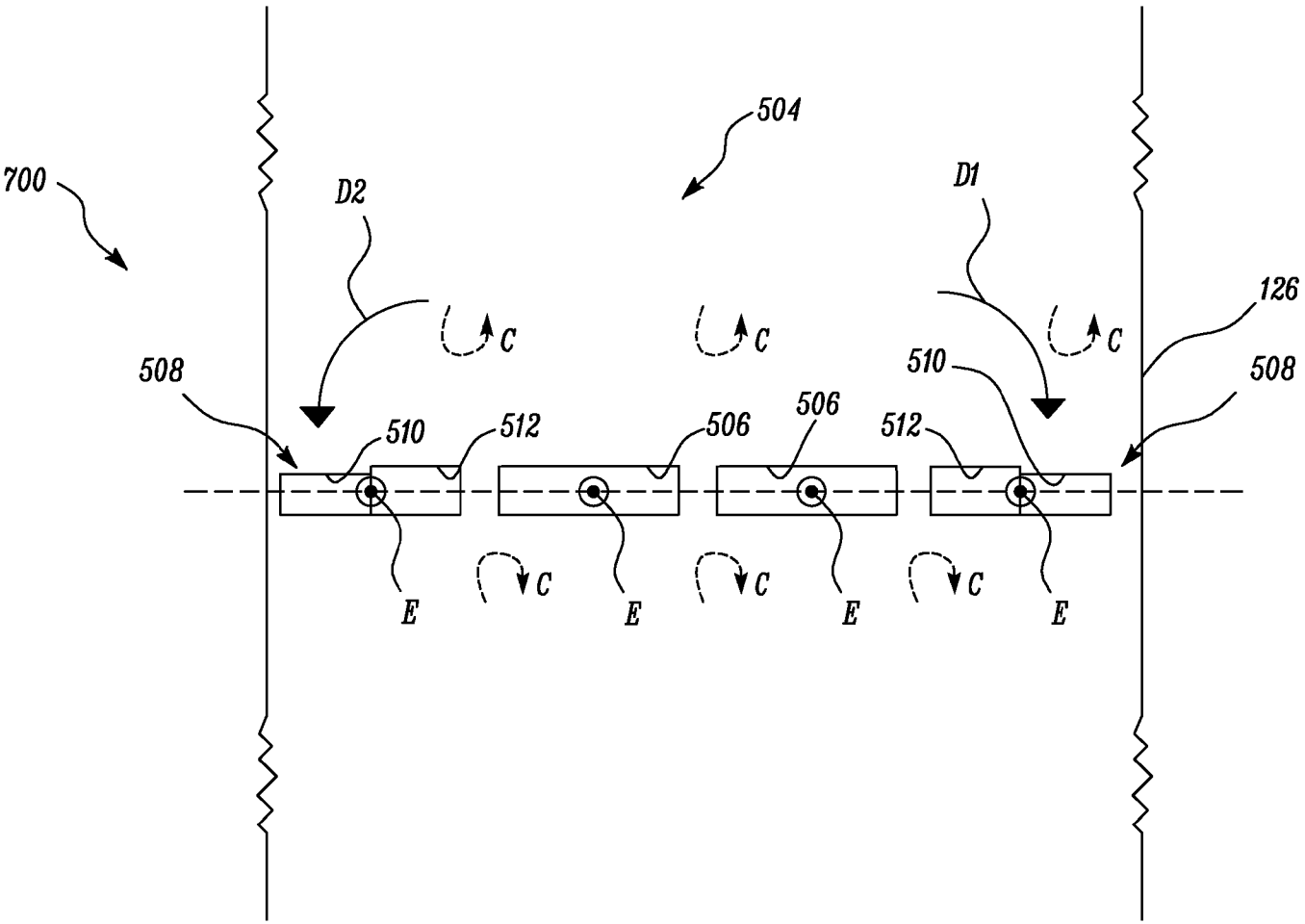

FIG. 7C illustrates a front schematic view of the first portion 510 in a closed position. As described earlier, with the opening of the first portion 510 to the open position to discharge the exhaust gases, the exhaust gas pressure supports the weight of the first portion 510. As the exhaust gases gets discharged from the housing 106, the exhaust gas pressure within the housing 106 drops. Further as the exhaust gas pressure drops below the predetermined threshold value, the weight of the first portion 510 enables the first portion 510 to attain the closed position.

INDUSTRIAL APPLICABILITY

A conventional ventilation system for a power system enclosure is typically provided with a pressure relief valve. The pressure relief valve is disposed on the power system enclosures, and requires space for installation. In some cases, the pressure relief valve may be further provided with a conduit with a purging system disposed therein. A purging system may transport exhaust gases to an area away from personnel. Further, the pressure relief valve may be disposed in a casing for noise reduction. Moreover, the pressure relief valve may be prone to failures, thereby requiring regular maintenance. Hence, conventional ventilation systems may be complex and costly.

The ventilation system 118 is provided according to an embodiment of the present disclosure. The ventilation system 118 includes the enclosure exhaust 122. The enclosure exhaust 122 further includes the outlet damper assemblies 119, 504 in different embodiments. The outlet damper assemblies 119, 504 include the exhaust dampers 206, 506, and the relief damper 208, 508, respectively. The relief damper 208, 508 is pivotally disposed in the enclosure exhaust 122. At least a portion of the relief dampers 208, 508 is configured to open during the event mode, when the exhaust gas pressure is above the predetermined threshold, to discharge the exhaust gases. The relief dampers 208, 508 may close after the exhaust gas pressure falls below the predetermined threshold. The relief dampers 208, 508 may therefore limit the pressure within the housing 106. The pressure within the housing 106 may be kept equal to or less than the predetermined threshold. Such an arrangement may be simple in structure, easy to maintain, and cost effective.

Further, following the release of the exhaust gases inside the power system enclosure 104, the exhaust gases (for example, carbon dioxide) may be typically heavier than air and will remain confined in the exhaust duct 126, thus acting as a buffer to keep a higher concentration of the exhaust gases within the power system enclosure 104 for a longer time. Such a buffer further enhances safety within the power system 100 as release of the exhaust gases may be gradual.

While aspects of the present disclosure have been particularly shown and described with reference to the embodiments above, it will be understood by those skilled in the art that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

We claim:

1. A power system comprising:

a power source; and a power system enclosure comprising:

a housing accommodating the power source therein;

an enclosure inlet connected to the housing to allow entry of an intake fluid into the housing;

an enclosure exhaust connected to the housing to route fluid from the housing; and a relief damper disposed in the enclosure exhaust, wherein at least a portion of the relief damper is configured to open when a pressure within the housing exceeds a predetermined threshold value; and wherein the relief damper includes a first portion and a second portion, wherein the first portion is pivotally connected to the second portion, and wherein the first portion is configured to open independently of the second portion when the pressure within the housing exceeds the predetermined threshold value.

2. The power system of claim 1, wherein the second portion is configured to be opened during a normal operational mode, and wherein the second portion is configured to be closed during an event mode.

3. The power system of claim 1, wherein the relief damper is spring actuated to be closed, and wherein the pressure within the housing actuates the relief damper to open against the spring actuation.

4. The power system of claim 1, wherein the relief damper is closed by a weight thereof, and wherein the pressure within the housing actuates the relief damper to open against the weight.

5. The power system of claim 1 further comprises an exhaust damper disposed in the enclosure exhaust, wherein the exhaust damper is configured to be opened during a normal operational mode, and wherein the exhaust damper is configured to be closed during an event mode.

6. The power system of claim 1 further comprises at least one of:

an inlet fan configured to selectively generate a flow of the intake fluid through the enclosure inlet; and an outlet fan configured to selectively generate a flow of fluid through the enclosure exhaust.

7. A power system comprising:

a power source; and a power system enclosure comprising:

a housing accommodating the power source therein;

an enclosure inlet connected to the housing to allow entry of an intake fluid into the housing;

an enclosure exhaust connected to the housing to route fluid from the housing; and a relief damper disposed in the enclosure exhaust, wherein the relief damper is configured limit a pressure within the housing; and, wherein:

at least a portion of relief damper is configured to open when the pressure within the housing exceeds a predetermined threshold value;

the relief damper includes a first portion and a second portion, wherein the first portion is pivotally connected to the second portion; and the first portion is configured to open independently of the second portion when the pressure within the housing exceeds the predetermined threshold value.

8. The power system of claim 7, wherein the second portion is configured to be opened during a normal operational mode, and wherein the second portion is configured to be closed during an event mode.

9. The power system of claim 7, wherein the relief damper is spring actuated to be closed, and wherein the pressure within the housing actuates the relief damper to open against the spring actuation.

10. The power system of claim 7, wherein the relief damper is closed by a weight thereof, and wherein the pressure within the housing actuates the relief damper to open against the weight.

11. The power system of claim 7 further comprises an exhaust damper disposed in the enclosure exhaust, wherein the exhaust damper is configured to be opened during a normal operational mode, and wherein the exhaust damper configured to be closed during an event mode.

12. The power system of claim 7 further comprises at least one of:

an inlet fan configured to selectively generate a flow of the intake fluid through the enclosure inlet; and an outlet fan configured to selectively generate a flow of fluid through the enclosure exhaust.

13. A power system comprising:

a power source;

a power system enclosure comprising:

a housing accommodating the power source therein;

an enclosure inlet connected to the housing to allow entry of an intake fluid into the housing;

an enclosure exhaust connected to the housing to route fluid from the housing;

an exhaust damper disposed in the enclosure exhaust, wherein the exhaust damper is configured to be opened during a normal operational mode, and wherein the exhaust damper is configured to be closed during an event mode; and a relief damper disposed in the enclosure exhaust, wherein at least a portion of the relief damper is configured to open when a pressure within the housing exceeds a predetermined threshold value; and wherein the relief damper includes a first portion and a second portion, wherein the first portion is pivotally connected to the second portion, and wherein the first portion is configured to open independently of the second portion when the pressure within the housing exceeds the predetermined threshold value.

14. The power system of claim 13, wherein the second portion is configured to be opened during the normal operational mode, and wherein the second portion is configured to be closed during the event mode.

15. The power system of claim 13 wherein the relief damper is spring actuated to be closed, and wherein the pressure within the housing actuates the relief damper to open against the spring actuation.

16. The power system of claim 13, wherein the relief damper is closed by a weight thereof, and wherein the pressure within the housing actuates the relief damper to open against the weight.

* * * * *